United States Patent [19]

Etienne et al.

[11] Patent Number: 4,997,380

[45] Date of Patent: Mar. 5, 1991

[54] ELECTRICAL CONNECTOR FOR CONNECTING A CABLE, IN PARTICULAR AN IGNITION LEAD, TO A TERMINAL

[75] Inventors: Christian Etienne, Choisy le Roi; Jacques Soccart, Paris, both of France

[73] Assignee: Societe d'Application Des Ferrites - Musorb Route d'Argentan, La Ferte-Mace, France

[21] Appl. No.: 476,764

[22] Filed: Feb. 8, 1990

[30] Foreign Application Priority Data

Feb. 14, 1989 [FR] France ..... 89 01904

[51] Int. Cl.[5] ..... H01R 4/50

[52] U.S. Cl. ..... 439/127; 439/835; 439/890

[58] Field of Search ..... 439/125, 127, 263, 285, 439/359, 352, 353, 834–836, 851–853, 890

[56] References Cited

U.S. PATENT DOCUMENTS 1,266,114 5/1918 Francis ..... 439/837

1,667,485 4/1928 MacDonald ..... 439/836

FOREIGN PATENT DOCUMENTS 1205573 9/1970 United Kingdom ..... 439/125

*Primary Examiner*—Eugene F. Desmond

*Attorney, Agent, or Firm*—Dennison, Meserole, Pollack & Scheiner

[57] ABSTRACT

An electrical connector of the type comprising a conducting part having one end for receiving an electrical cable and one end suitable for connection to a terminal, said connection end being constituted by an elastically deformable split ring of shape adapted to the shape of the terminal, and extending the cable axially, the connector also including a rigid insulating sleeve suitable for sliding axially around the cable and the conducting part between a first position where it is disengaged from the ring in order to enable it to be put into place on the terminal or removed from the terminal, and a second position where it is engaged on the ring in order to clamp the ring on the terminal.

7 Claims, 2 Drawing Sheets

F
G

ELECTRICAL CONNECTOR FOR CONNECTING A CABLE, IN PARTICULAR AN IGNITION LEAD, TO A TERMINAL

The invention relates to an electrical connector of the type comprising a conducting part having one end for receiving an electric cable and having one end suitable for connection on a terminal.

BACKGROUND OF THE INVENTION

There already exist connectors of this kind, which connectors are suitable for axially extending the cables to which they are fixed and they have connection ends constituted by respective elastically deformable split rings shaped to match the shape of the corresponding terminals.

Such connectors are used, in particular, in the ignition systems of internal combustion engines for connecting ignition leads to a coil, to a distributor, or to a terminal forming a part of ignition component such as a spark plug.

In this application to ignition leads, a cap is also provided which surrounds the lead and the conducting part and which is suitable for providing moisture-proof sealing between the lead and the terminal or the terminal-carrying member, in order to ensure electrical insulation.

These connectors are required, under all circumstances, to provide excellent radial clamping of the split ring on the terminal in order to obtain good electrical contact, even after several connection and disconnection operations.

It is also necessary for these connection and disconnection operations to be capable of being performed manually without the force required for installing the split ring on a terminal or for withdrawing it from the terminal exceeding established standards.

With prior connectors of this kind, it often happens that the radial clamping force of the ring becomes less, particularly under the effect of large amounts of vibration or acceleration, thereby reducing the quality of the electrical connection between the split ring and the terminal. Micro circuit disconnections then occur which give rise to poor ignition and thus to poor combustion in the engine, causing unburnt gases and harmful gases to occur in the exhaust.

Proposals have been made to mitigate this drawback by reinforcing the split ring so that it provides a higher degree of radial clamping, and therefore provides better electrical contact with the terminal.

Unfortunately, this solution suffers from the drawback that the force required for installing the ring on the terminal and for removing it from the terminal is thus increased. Consequently increasing the clamping force of the split ring is done to the detriment of ease of connection and disconnection, and this is not acceptable because of the standards laid down.

Consequently, an object of the invention is to provide an electrical connector of the type defined in the introduction which enables the radial clamping to be reinforced, thereby reinforcing the electrical contact between the split ring and the terminal.

Another object of the invention is to provide a connector of this kind in which the force required for installing the split ring on the terminal or for removing it from the terminal is of substantially the same magnitude as the force required for prior art connectors, or even smaller.

Another object of the invention is to provide such a connector in which the radial clamping force of the ring is not altered, even after several connection and disconnection operations.

Another object of the invention is to provide such a connector which is particularly intended for the leads of the ignition systems of internal combustion engines.

Another object of the invention is to provide a connector, particularly for ignition leads, which provides good sealing between the lead and the terminal or the component which carries the terminal.

Another object of the invention is to provide a connector of this kind which makes it possible to perform connection and disconnection operations under conditions which are very close to those of known connectors.

Another object of the invention is to provide such a connector which can be fitted to standard terminals, in particular on ignition components.

SUMMARY OF THE INVENTION

More precisely, the present invention provides a connector of the type defined in the introduction, which connector includes a rigid insulating sleeve suitable for sliding axially around the cable and the conducting part between a first position where it is disengaged from the ring in order to enable it to be put into place on the terminal or removed from the terminal, and a second position where it is engaged on the ring in order to clamp the ring on the terminal.

Thus, when the sleeve is in the ring-disengaged position, the ring can be put into place on the terminal and the sleeve can subsequently be displaced to the ring-engaged position, thereby clamping the ring onto the terminal and thus making it substantially impossible to pull the ring off the terminal.

If it is desired to separate the split ring from the terminal, it is necessary first to displace the sleeve from its ring-engaged position towards its ring-disengaged position, and then to withdraw the ring from the terminal.

As a result, installing the split ring on the terminal and removing it from the terminal require a force of substantially the same size, or even less, than the force that needs to be exerted on prior art connectors, since there is no need to reinforce the clamping of the split ring.

In a preferred embodiment of the invention, the sleeve is generally cylindrical in shape and includes, at one end, a frustoconical inside wall which is flared towards said end in order to facilitate engaging the sleeve on the split ring.

Advantageously, the frustoconical inside wall leads to an intermediate cylindrical inside wall suitable for radially clamping the split ring and leading in turn to the other end of the sleeve via a slightly flared frustoconical wall.

The intermediate inside wall constitutes the active portion of the sleeve which prevents radial expansion of the ring when the sleeve is in its position engaged on the ring. The slightly flared frustoconical wall is intended to facilitate axial sliding of the sleeve along the electric cable, whenever the sleeve is displaced to one or other of its two extreme positions.

According to another feature of the invention, the connector further includes a cap made of flexible insulating material, fixed to the sleeve and having a first endpiece suitable for being clamped in sealed manner around the cable and a second endpiece suitable for fitting in sealed manner around the terminal and/or around a component supporting the terminal, the cap being axially deformable in order to enable it to be displaced relative to the split ring and cause the sleeve to pass from one of its two positions to the other.

In a first variant embodiment, the cap is constituted by a single piece and comprises a body which completely surrounds the sleeve, the body being connected at one end to the endpiece clamped on the cable via a deformable sealed bellows, said body forming the sealing endpiece at its other end.

In another variant embodiment, the cap is made of two pieces, namely a first piece having a body which surrounds one end of the sleeve and which is connected to the endpiece clamped on the cable via a deformable sealed bellows, and a second piece having a body which surrounds the other end of the sleeve and which forms the sealing endpiece.

In both of the above-mentioned variants, the deformable moisture-proof bellows allows the sleeve to slide between its two extreme positions, with the bellows being compressed in its position disengaged from the ring, and on the contrary being extended in its position engaged on the ring.

Advantageously, the deformable and moisture-proof bellows is compressed in its natural, or rest, position, thereby maintaining the sleeve in its position disengaged from the split ring.

In the position where the split ring is engaged on the terminal and the sleeve is in its position engaged on the ring, the cap then ensures continuity of moisture-proof sealing between the electrical cable and the terminal or the component carrying the terminal.

In another aspect, the invention provides an electric cable, in particular a lead for an ignition system, fitted with a connector as defined above at at least one of its ends.

BRIEF DESCRIPTION OF THE DRAWINGS

Embodiments of the invention are described by way of example with reference to the accompanying drawings, in which.

DETAILED DESCRIPTION

Figures 1, 2, 3:
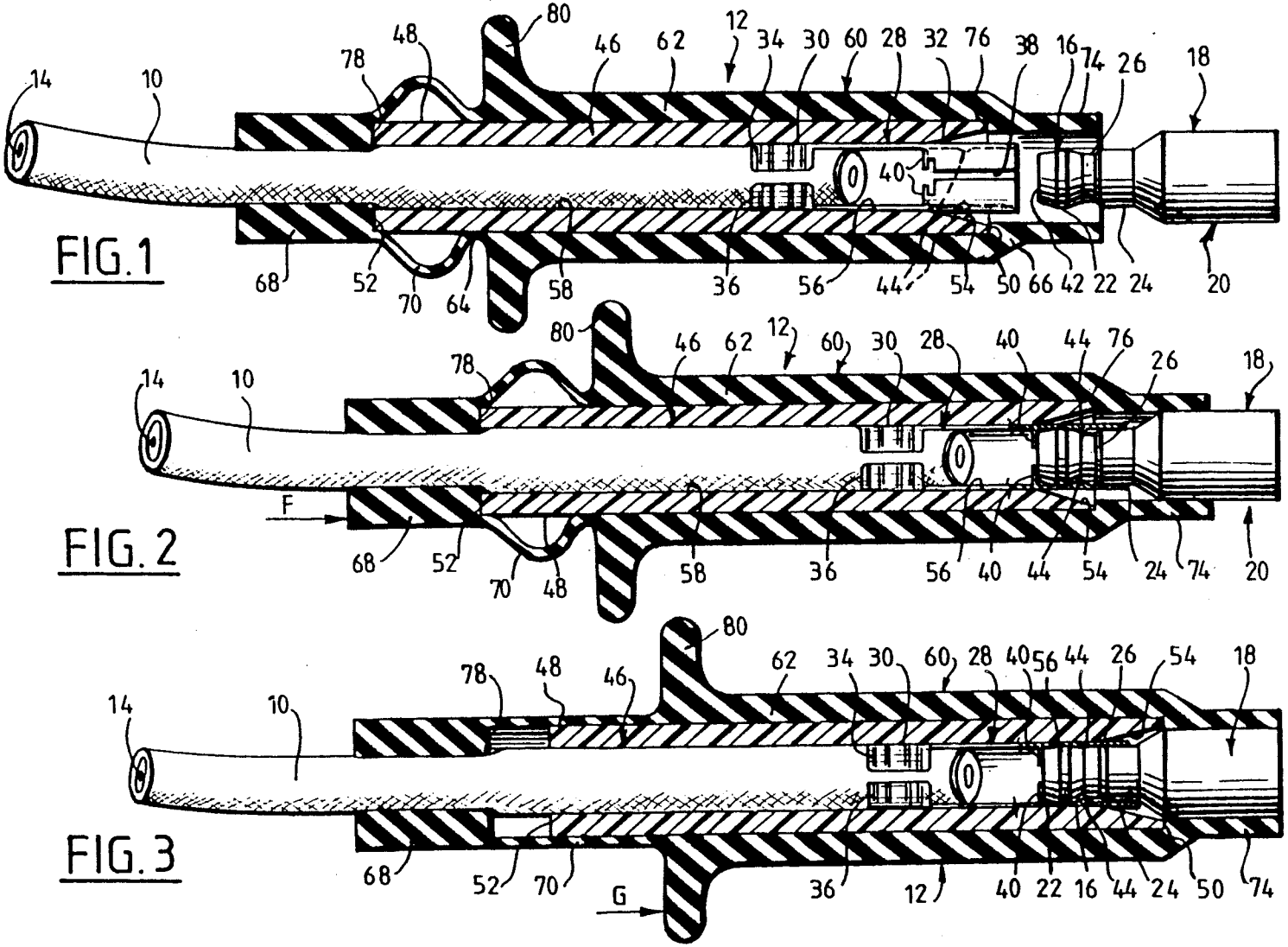
FIG. 1 is a section view through a connector fitted to the end of an ignition lead and shown prior to placing on the terminal of a spark plug, with the sleeve being in its disengaged position.
FIG. 2 is a view analogous to FIG. 1, in which the split ring is in place on the terminal, while the sleeve is still in its disengaged position.
FIG. 3 is a view analogous to FIG. 2, in which the split ring is in place on the terminal and the sleeve is in its engaged position on the ring.

Reference is made initially to FIG. 1 which shows an ignition lead 10 provided at one of its ends with a connector 12 of the invention. The connector is intended to provide electrical connection between the conducting core 14 of the lead and a terminal 16 carried by the porcelain insulator 18 of a spark plug 20 which is shown in part, only.

The terminal 16 is generally circularly symmetrical and comprises, in conventional manner, a leading portion 22 having insertion and retaining chamfers, and connected to a trailing portion 24 via a smaller diameter cylindrical portion 26 constituting a peripheral annular groove.

The connector 12 comprises a single piece of conducting part 28 having an end 30 for receiving the lead 10 and an end 32 suitable for connection on the terminal 16.

The lead-receiving end 30 is generally cylindrical in shape and comprises two tabs 34 and 36 which are suitable for clamping to the end of the lead 10 which is to be connected to the terminal 16. The connection end 32 is constituted by an elastically deformable cylindrical split ring whose shape matches that of the terminal, and which extends axially from the lead 10. The ring delimits a slot 38 running parallel to the axis of the conducting part.

The connection end 32 also includes at least two tabs 40 folded radially inwards from the conducting part 28 and suitable for coming into abutment against the end face 42 of the terminal 16 when the split ring is put into place on the terminal.

The connection end 32 also includes at least two bulges 44 projecting inwards from the split ring and suitable for taking up position in the annular groove of the terminal 16 while the tabs 40 bear against the end face 42 of the terminal.

The electrical contact between the conducting part 28 and the conducting core 14 of the lead is provided in conventional manner by a metal conducting staple (not shown) having two branches interconnected by a bend. One of the branches of the staple is inserted between the core and the sheath of the lead, while the other branch thereof is inserted between the end 30 of the part 28 and the outside of the cable sheath.

The connector 12 also includes a rigid insulating sleeve 46, e.g. made from a thermosetting resin, which is generally cylindrical in shape and which is suitable for sliding axially along the lead 10 and around the conducting part 28 which extends the lead axially. The sleeve 48 has a generally cylindrical outside wall 48 extending from its leading end 50 to its trailing end 52. At its leading end 50, the sleeve 46 has an outwardly flared frustoconical inside wall 54. The flared wall 54 leads to an intermediate cylindrical wall 56 suitable, as explained below, for radially clamping the split ring, said wall 56 leading, at the opposite end 52 of the sleeve to a frustoconical wall 58 which is very slightly flared towards the end 52. It is preferable for the wall 58 to be very slightly flared rather than being accurately cylindrical in order to facilitate axial sliding of the sleeve 46 along the lead 10.

The connector shown in FIG. 1 also includes a one-piece cap 60 made of flexible insulating material and comprising a generally cylindrical body 62 which completely surrounds the sleeve 46.

The body 62 extends between two ends 64 and 66. The end 64 runs via a deformable and moisture-proof bellows 70 to a generally cylindrical first endpiece 68. In its natural position, the bellows 70 is in its compressed state.

The endpiece 68 is suitable for being clamped in moisture-proof manner around the lead 10 and for being prevented from moving in translation or rotation relative to the lead 10.

The end 66 of the cap body 62 forms a second endpiece 74 which is generally cylindrical in shape and suitable for fitting in sealed manner around the terminal 16 and/or the insulating body 18 supporting the terminal 16.

The body 62 of the cap has an internal annular shoulder 76 constituting a permanent abutment for the end 50 of the sleeve 46, and an annular shoulder 78 constituting an abutment for the end 52 of the sleeve 46 when the bellows is in the compressed state (FIG. 1 and FIG. 2).

In addition, the body 62 of the cap 60 includes grasping means in the vicinity of its end 64, which grasping means are constituted in the present example by an annular collar 80.

Operation of the connector is now described with reference to FIGS. 1 to 3.

Initially, the connector is presented to the end of the terminal 16 of the spark plug 20 so that its connection end 32 (split ring) is situated facing and in alignment with the terminal 16. Since the bellow 70 is in its compressed, natural state, the sleeve 46 is in a position which is disengaged from the split ring, with the cylindrical inside wall 56 of the sleeve not being in contact with the split ring. Consequently, the end 52 of the sleeve is in abutment against the annular shoulder 78 (FIG. 1).

Axial thrust is then applied to the endpiece 68 of the cap 60 as shown by the arrow F in FIG. 2, thereby engaging the split ring on the terminal 16, with the sleeve 46 still being in its disengaged position and with the bellows 70 still being in its compressed state. While the split ring is coming into engagement with the terminal, the ring expands radially, and at the end of insertion, the tabs 40 of the conducting part 28 bear against the end face 42 of the terminal 16, while the bulges 44 on the conducting part are received in the annular groove delimited by the terminal 16.

Thereafter, an axial force is applied on the collar 80 as shown by arrow G in FIG. 3, thereby causing the sleeve 46 to slide relative to the lead 10 and the conducting part 28. At the end of its stroke the intermediate cylindrical inside wall 56 of the sleeve 46 surrounds the split ring and prevents it from expanding radially such that it is practically impossible to pull the lead off the terminal. In the position shown in FIG. 3, the bellows 70 is fully expanded and the end 52 of the sleeve 46 is at a distance from the internal shoulder 78 of the cap 60. Further, the endpiece 74 provides moisture-proof sealing around the insulating body 18 of the spark plugs 20.

These two successive operations thus take place by exerting thrust on the cap, with the thrust being applied to a region thereof which is at a distance from the terminal, thereby facilitating installing the connector in locations where access is difficult, e.g. in a recess on the cylinder head of an engine.

If it is desired to withdraw the split ring from the terminal, then the above operations should be performed in reverse order, initially moving the sleeve away from its position engaged on the ring to its position disengaged from the ring, and then exerting traction on the assembly in order to extract the split ring, which then expands radially during extraction.

In practice, these two operations take place as a single movement. It suffices to exert traction on the collar 80 in order firstly to displace the sleeve to its disengaged position and subsequently to extract the split ring.

Figure 4:
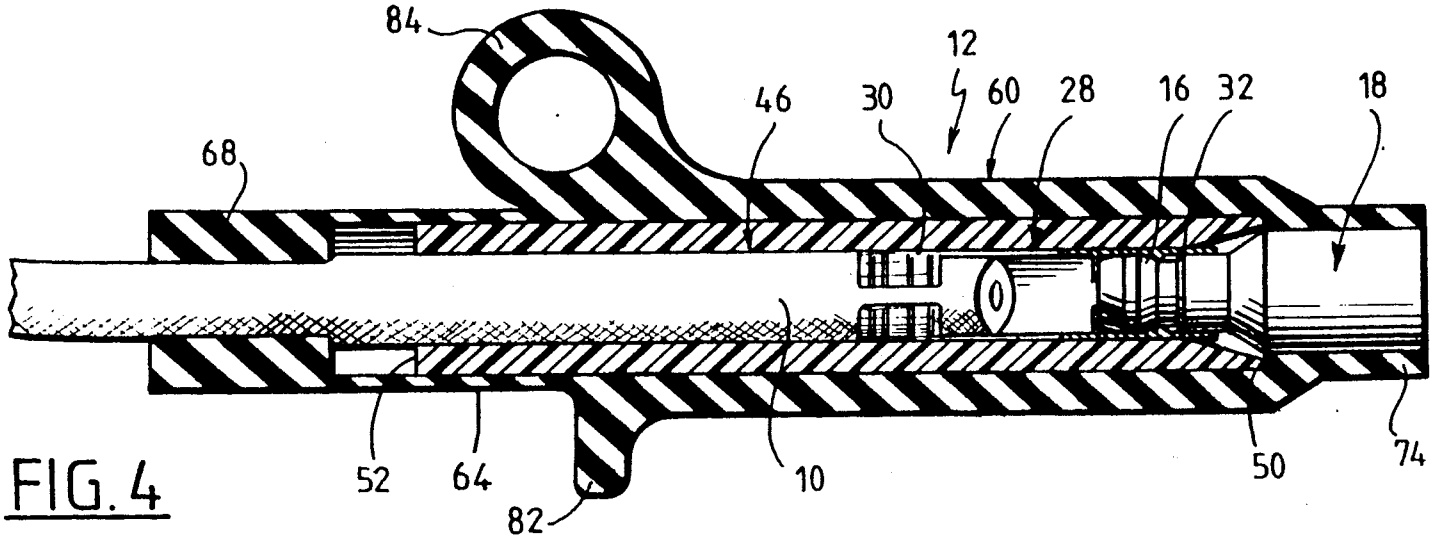
FIG. 4 is a section view analogous to FIG. 3, showing a variant embodiment.

Reference is now made to FIG. 4 which shows a variant embodiment of the connector shown in FIGS. 1 to 3. In this variant embodiment, the means for grasping the cap 60 include, in the vicinity of the end 64 of the cap, firstly a pushing surface 82 for displacing the sleeve 46 from its position where it is disengaged from the ring to its position where it is engaged on the ring, and secondly a traction ring 84 facilitating displacement of the sleeve from its position where it is engaged on the ring to its position where it is disengaged from the ring, thereby facilitating extracting the split ring from the terminal.

Figure 5:
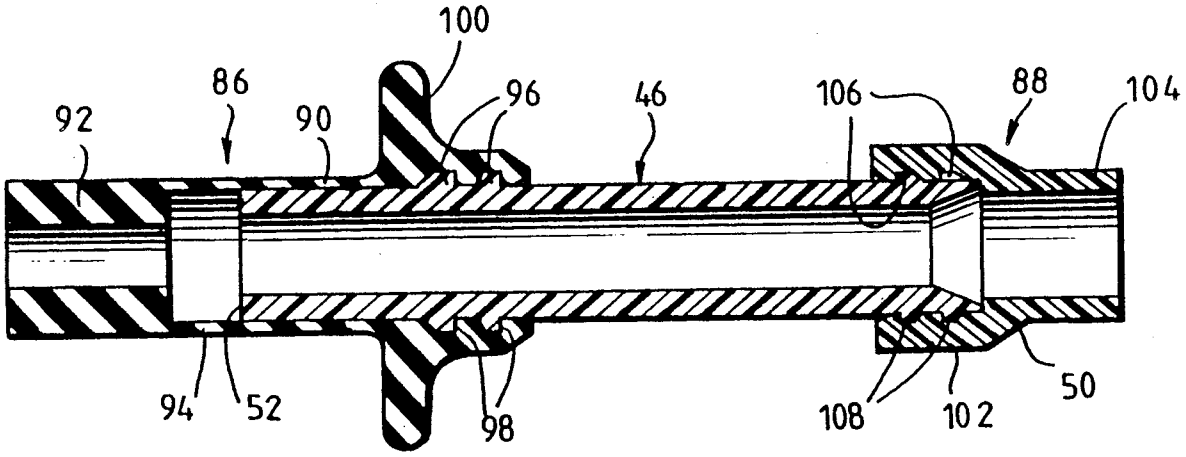
FIG. 5 is a section view through a sleeve provided with a two-part insulating cap.

Reference is now made to FIG. 5 which shows yet another variant embodiment in which the cap is not formed as a single piece as described above, but comprises two pieces 86 and 88. The piece 86 comprises a body 90 which surrounds the end 52 of the sleeve 46 and which is connected to a first endpiece 92 (analogous to the above-described endpiece 68) suitable for being clamped and locked in sealed manner around the lead 10. The body 90 is connected to the endpiece 92 via a deformable moisture-proof bellows 94 analogous to the above-described bellows 70. Here again, the natural position of the bellows is the compressed state. The body 90 is fixed to the sleeve 46 by internal annular grooves 96 which co-operate with external annular ribs 98 on the sleeve 46. In addition, the body 90 is provided with a collar 100 analogous to the collar 80 described above.

The second piece 88 of the cap comprises a body 102 which surrounds the other end 50 of the sleeve 46 and which forms an endpiece 104 analogous to the endpiece 74 described above. The body 102 is fixed in position on the sleeve 46 by internal annular grooves 106 which co-operate with external annular ribs 108 on the sleeve 48.

The connector shown in part in FIG. 5 is used in exactly the same way as the connector shown in FIGS. 1 to 3.

Naturally, the invention is not limited to connecting an ignition lead to a terminal on an ignition component such as a spark plug, a distributor, or a coil.

We claim:

1. An electrical connector of the type comprising a conducting part having a first end for receiving an electrical cable and a second end suitable for connection to a terminal, said second end comprising an elastically deformable split ring of a shape adapted to the shape of the terminal, and extending the cable axially; said connector including a rigid insulating sleeve adapted to slide axially around the cable and the conducting part between a first position disengaged from said split ring to enable engagement and removal of said split ring from the terminal, and a second position wherein said sleeve is engaged on said split ring to clamp said split ring on the terminal, said sleeve being generally cylindrical in shape and comprising a leading end adjacent said split ring, a frustoconical inside wall within said sleeve flared toward said leading end to facilitate engaging said sleeve on said split ring, an intermediate cylindrical inside wall within said sleeve and extending inward of said frustoconical inside wall, relative to said leading end, for radially clamping said split ring, said sleeve including a trailing end and a slightly flared frustoconical wall extending from said cylindrical inside wall to said trailing end.

2. A connector according to claim 1, wherein said sleeve is made of a rigid thermosetting resin.

3. An electrical connector of the type comprising a conducting part having a first end for receiving an electrical cable and a second end suitable for connection to a terminal, said second end comprising an elastically deformable split ring of a shape adapted to the shape of the terminal, and extending the cable axially; said connector including a rigid insulating sleeve adapted to slide axially around the cable and the conducting part between a first position disengaged from said split ring to enable engagement and removal of said split ring from the terminal, and a second position wherein said sleeve is engaged on said split ring to clamp said split ring on the terminal, and a cap made of flexible insulating material, said cap being fixed to the sleeve and having a first endpiece adapted to clamp in sealed manner around the cable and a second endpiece adapted to fit in sealed manner around the terminal and/or around a component supporting the terminal, said cap being axially deformable to enable it to be displaced relative to said split ring and allow said sleeve to pass from one of its two positions to the other.

4. A connector according to claim 3, wherein said sleeve includes first and second ends, said cap being made of two pieces, namely a first piece having a body which surrounds said first end of said sleeve and is connected to said first endpiece via a deformable sealed bellows, and a second piece having a body which surrounds said second end of said sleeve and which forms said second endpiece.

5. A connector according to claim 3, wherein said cap is provided with grasping means facilitating axial sliding of said sleeve along the cable and the conducting part for movement between said first position and said second position, and between said second position and said first position.

6. A connector according to claim 3, wherein said cap is formed of a single piece and comprises a body which completely surrounds said sleeve, said body having one end connected to said first endpiece via a deformable sealed bellows, said body forming said second endpiece at its other end.

7. A connector according to claim 6, wherein said deformable sealed bellows is compressed when in its natural position, thereby holding said sleeve in its first position disengaged from said split ring.

* * * * *